US006912805B2

(12) United States Patent
Ngan

(10) Patent No.: US 6,912,805 B2
(45) Date of Patent: Jul. 5, 2005

(54) MAGNETIZED CARD HOLDER

(76) Inventor: Chi Lung Ngan, 5 Bradford Rd., Edison, NJ (US) 08820

( * ) Notice: Subject to any disclaimer, the term of this patent is extended or adjusted under 35 U.S.C. 154(b) by 20 days.

(21) Appl. No.: 10/736,586

(22) Filed: Dec. 17, 2003

(65) Prior Publication Data

US 2004/0261306 A1 Dec. 30, 2004

Related U.S. Application Data

(63) Continuation-in-part of application No. 10/601,853, filed on Jun. 24, 2003, now Pat. No. 6,745,508.

(51) Int. Cl.[7] ..... G09F 3/18

(52) U.S. Cl. ..... 40/642.02; 40/649; 40/661; 40/661.01

(58) Field of Search ..... 40/642.02, 649, 40/661, 661.01, 625, 124.04; 283/75

(56) References Cited

U.S. PATENT DOCUMENTS

| | | | | | |
|---|---|---|---|---|---|
| 2,640,287 | A | * | 6/1953 | Lacoursiere | 40/649 |
| 3,826,026 | A | * | 7/1974 | Bevan | 40/661 |
| 3,943,645 | A | * | 3/1976 | Viesturs | 40/661 |
| 4,141,400 | A | * | 2/1979 | Mangan | 206/39.6 |
| 4,310,978 | A | * | 1/1982 | Stern | 40/661.01 |
| 4,979,323 | A | | 12/1990 | Wenkman et al. | |
| 5,040,671 | A | * | 8/1991 | Hager | 40/661 |
| 5,069,333 | A | * | 12/1991 | Chen | 206/39.5 |
| 5,075,991 | A | | 12/1991 | Wenkman et al. | |
| 5,077,925 | A | * | 1/1992 | Herrera et al. | 40/642.02 |
| 5,224,600 | A | * | 7/1993 | Neugebauer | 40/661 |
| 5,274,937 | A | | 1/1994 | Birnbaum | |
| 5,309,659 | A | | 5/1994 | Eastman | |
| D377,808 | S | | 2/1997 | Coe | |
| 5,613,602 | A | | 3/1997 | Lage et al. | |
| 5,680,709 | A | | 10/1997 | Stone | |
| 5,983,537 | A | | 11/1999 | Johnson | |
| 6,216,377 | B1 | | 4/2001 | Painsith | |
| 6,306,290 | B1 | | 10/2001 | Rolfes | |
| 2002/0133992 | A1 | | 9/2002 | Wu | |

* cited by examiner

*Primary Examiner*—Gary C. Hoge
(74) *Attorney, Agent, or Firm*—Shlesinger, Arkwright & Garvey LLP

(57) ABSTRACT

A magnetic card holder for mounting on a magnet attracting surface having a flexible and transparent and removable window positionable in a pocket over a card inserted in the pocket and locking the card in the pocket with means for subsequently unlocking the flexible transparent and removable window for removal of the card which locking means involves flexing of the card holder simultaneously with flexing of the flexible transparent and removable window.

4 Claims, 3 Drawing Sheets

MAGNETIZED CARD HOLDER

CROSS-REFERENCE TO RELATED APPLICATIONS

This invention is a continuation-in-part of U.S. application Ser. No. 10/601,853, filed Jun. 24, 2003 now U.S. Pat. No. 6,745,508 which is incorporated herein by reference.

FIELD OF THE INVENTION

This invention relates to a magnetic card holder which can be secured to a magnet attracting surface such as a refrigerator, cabinet or the like with means for locking a card in the holder by a flexible transparent window which may be unlocked to permit insertion of a new card in the holder.

BACKGROUND OF THE INVENTION

Magnetized card holders are presently available for quick reference in kitchens or offices or the like such as illustrated in patents to Stone U.S. Pat. No. 5,680,709; Birnbaum U.S. Pat. No. 5,274,937; Eastman U.S. Pat. No. 5,309,659; Johnson U.S. Pat. No. 5,983,537; Wenkman et al. U.S. Pat. No. 5,075,991 and U.S. Pat. No. 4,979,323; Wu Publication No. U.S. 2002/0133992 A1; Lage U.S. Pat. No. 5,613,602; Penner Des. 325,048; and Coe Des. 377,808.

The Wenkman et al. patents above and Painsith U.S. Pat. No. 6,216,377 typically show front loading frame-type devices in which the window is snapped into place and removed by applying thumb pressure on the back through a hole which will allow for pushing of the window and card outwardly from the frame.

Some of the references referred to above apply adhesive to the card making it difficult if not impossible to replace the card in a frame with a new card.

OBJECTS AND SUMMARY OF THE INVENTION

An object of the present invention is to provide a magnetic display device for magnetically attaching the device to a magnet attracting surface such as a refrigerator, cabinet or the like.

Another object of this invention is to provide a magnetic card holder which will securely hold the card in position on the surface on which it is posted.

A further object of this invention is to provide a magnetic card holding device having means for replacing the old card with a new card.

Still a further object of this invention is to provide a magnetic card holder which locks the window in position, but permits the window to be unlocked from the frame for replacement with a new card.

Yet a further object of this invention is to provide a magnetic card holder which is easy and inexpensive to manufacture.

Still a further object of this invention is to provide a card holder which does not require the use of an adhesive material for mounting the card.

Another object of this invention is to provide a card holder which maintains the card in proper alignment with the frame thus creating an attractive appearance.

Still a further object of this invention is to provide an attractive display device suitable for use with advertisements, photographs, business cards, and the like.

Yet another object of this invention is to provide a magnetic card holder in which the material for the flexible magnetic card receiving frame and the flexible transparent and removable window have memory so that they will return to their original state after being flexed to unlock the window from the frame to position a new card.

A further object of this invention is to provide a magnetic card holder which keeps the card clean and unmarked at all times.

In summary, this invention relates to a magnetic card holder which provides a transparent cover for the card to protect the surface thereof for proper viewing, but also permits ease in removing the transparent window to remove the card and replace the same with a new card.

These and other objects of the invention will be apparent from the following description and claims including the drawings which are as follows:

DESCRIPTION OF THE PREFERRED EMBODIMENT

Figure 3:
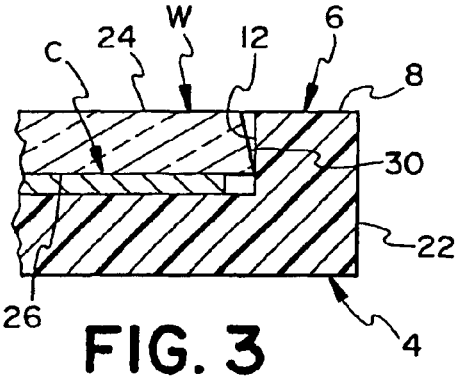
FIG. 3 is an enlarge cross-sectional view taken along the line 3—3 of FIG. 1 and viewed in the direction of the arrows.

The magnetic card holder H comprises a flexible magnetic card receiving frame 2 having a magnetic backing plate 4. The backing plate 4 has an upstanding peripheral lip 6. The upstanding lip 6 has a top surface 8, an outer surface 10 and an inner surface 12. Steps 14 and 15 are provided on opposite sides 16 and 18 of lip 6 on the inner surface 12 of the upstanding peripheral lip 6. The inner surface 12 of sides 20 and 22 of the upstanding peripheral lip 6 are not stepped as noted in FIGS. 3 and 4. The flexible magnetic card receiving frame 2 may be of plastic or metal having memory so that the flexible magnetic card receiving frame can be flexed without losing its planar position when released from the flexed position. The flexible magnetic card receiving frame 2 together with the backplate 4 and the upstanding peripheral lip 6 forms a card receiving pocket P for receiving a calling card, photograph, clipping C or the like. The card C is positioned in the pocket P and it butts the inner surface 12 of the upstanding peripheral lip 6. The thickness of the card C approximates the height of the steps 14 and 15 so that the top surface of the card C is substantially the same as the top surface of the steps 14 and 15.

Positioned on top of the card C is a flexible, transparent and removable window which is made from plastic or flexible durable glass not readily broken. When the window W is positioned in the pocket P the top 24 of the window W is substantially planar with the top surface 8 of the upstanding peripheral lip 6.

Figure 2:
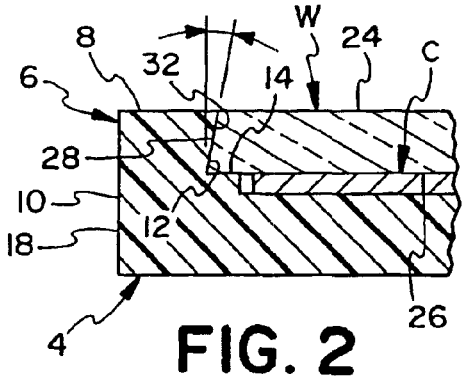
FIG. 2 is an enlarged fragmentary cross-sectional view taken along the lines 2—2 of FIG. 1 and viewed in the direction of the arrows and showing the angle of bevel.

The window W which protects the card C has beveled edges 28 and 30 which engage the inner surface 12 of the upstanding peripheral lip 6. The inner surface 12 on the sides 16 and 18 are also beveled as at 32 in FIG. 2. The degree of bevel of the edges 28 and 30 of the window W and of the beveled inner surface of the lip 32 have a beveled angle of about 7.5° degrees to about 12.5° degrees and preferably about 10° degrees as illustrated in FIG. 2. The beveled edges 28 and 30 of the window W provide a friction fit with the inner surface 12 of the upstanding peripheral lip 6. When the window W is positioned in the card receiving pocket P, it locks the card in the pocket until a decision is made to remove the card C and substitute a new card therefore. The friction fit locks the window W over the card C which may be unlocked to remove the card C as will be described here and after.

Figure 1:
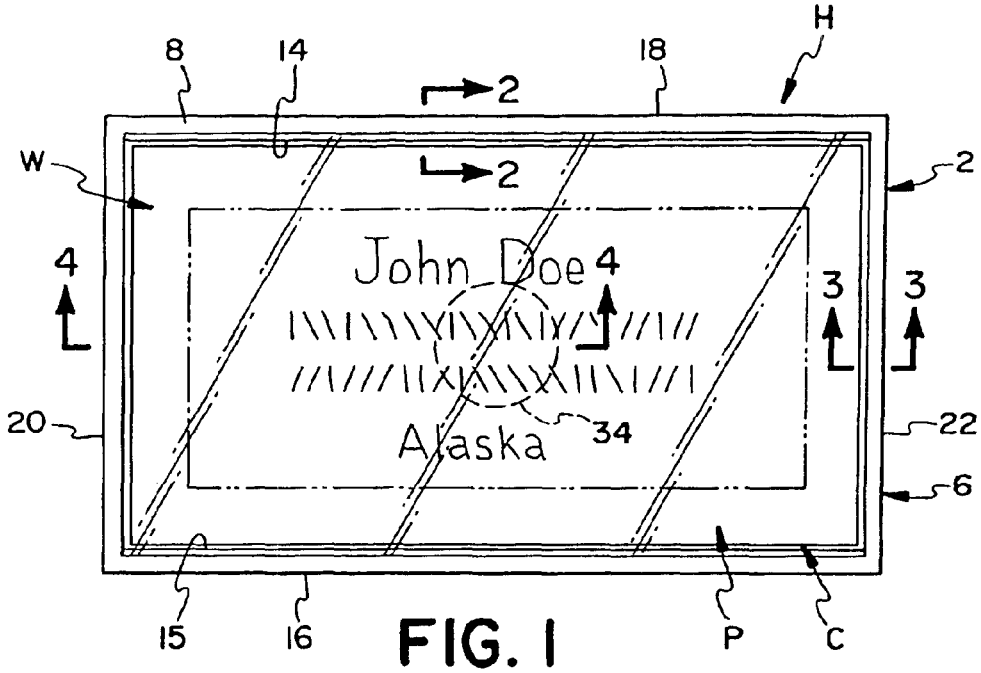
FIG. 1 is a top plan view showing in phantom lines that portion of a card which would hold information and the outline of a magnet positioned in a card holder.
Figure 4:
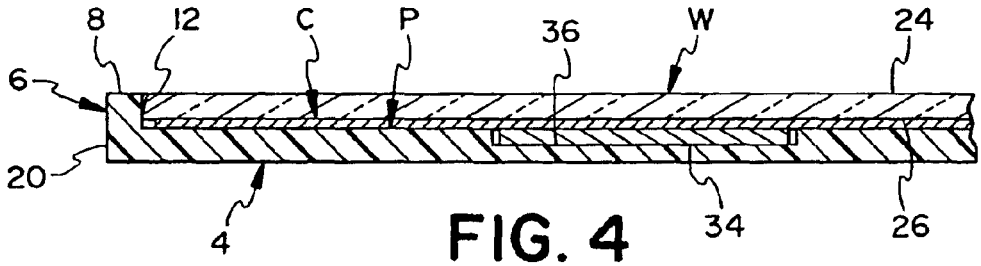
FIG. 4 is a fragmentary cross-sectional view taken along the lines 4—4 in FIG. 1 and viewed the direction of the arrows.

The flexible magnetic card receiving frame 2 may be made from any well know plastic magnetic material or magnetic metallic compound. In FIGS. 1 and 4, a thin magnet 34 is mounted or imbedded in a magnet receiving pocket 36. The magnet 34 may be imbedded in the back plate 4 so that the back plate 4 extends beneath the magnet 34 so as to not be visible when the material of the flexible magnetic card receiving frame 2 is opaque.

Figure 5:
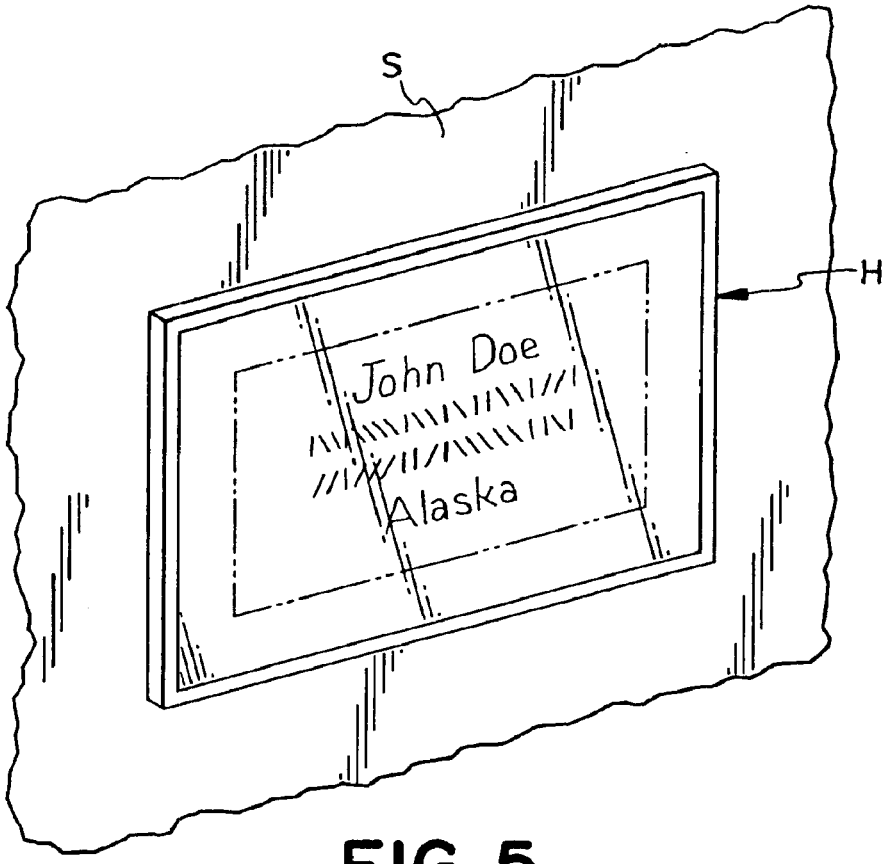
FIG. 5 is a perspective view showing the invention mounted on a magnet attracting surface.

FIG. 5 shows the magnetic card holder H mounted on a magnetic attracting surface S such as refrigerator or a metallic cabinet or the like.

Unlocking the Card from the Magnetic Card Holder

Figure 6:
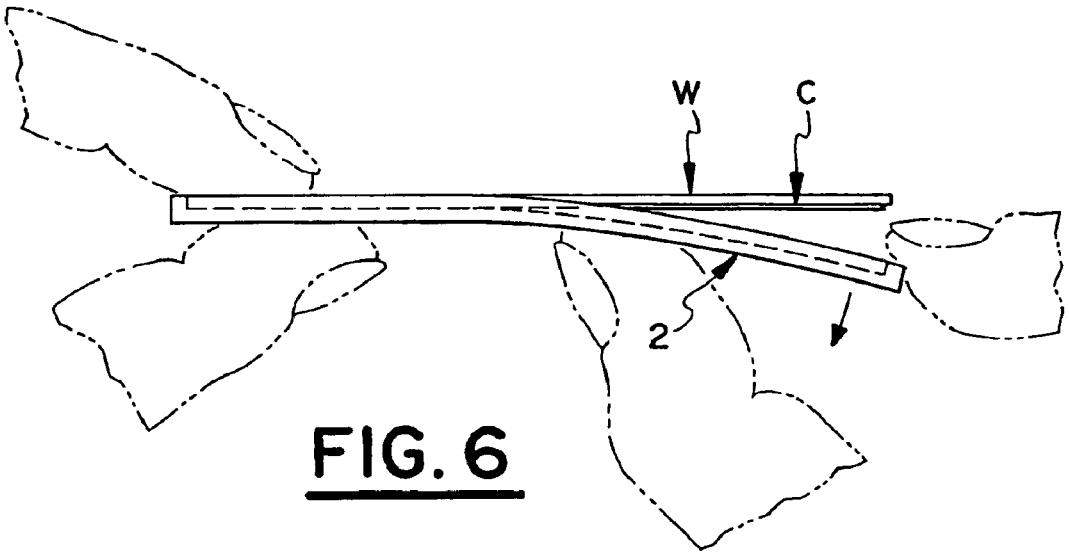
FIG. 6 is a side elevational view of the invention portions shown in phantom lines showing the release of the window from the flexible magnetic card receiving frame by applying finger pressure of one hand when held in the other hand.

It will be noted that the window W must be inserted into the card receiving pocket P with the beveled edges 28 and 30 slopped outwardly from the top of the window 24 to the bottom of the window 26. Beveled edges 30 of the window W engage the inner surface 12 of the sides 20 and 22 in a friction grip. The beveled edges 28 of the window W frictionally grip the cooperating beveled edges 28 of the upstanding peripheral lip 6. As illustrated in FIG. 6, thumb pressure applied to the bottom of the magnetic card holder H will cause the flexible magnetic card receiving frame 2 and the window W to flex downwardly. Since the beveled edge 30 of the window W engages the vertical surface inner surface 12 of the sides 20 and 22, the downward bending causes a release of the edges 30 on the sides 20 and 22 causing the window W to flex upwardly from card receiving pocket P permitting withdrawal of the window W from the card receiving pocket P. The 7½° to 12½° degree angle permits ease and release of the window W from the card receiving pocket P. A greater angle would not permit unlocking of the window W. In addition, the fact that there is no step on the sides 20 and 22 aid in the flexing downwardly of the magnetic card holder H and the release of the window W thereby unlocking the card C. The flex of the magnetic card holder H and the window W under thumb pressure will unlock the window W at an angle of from about 20° to about 35° flex.

Modifications FIGS. 7 through 10

Figure 7:
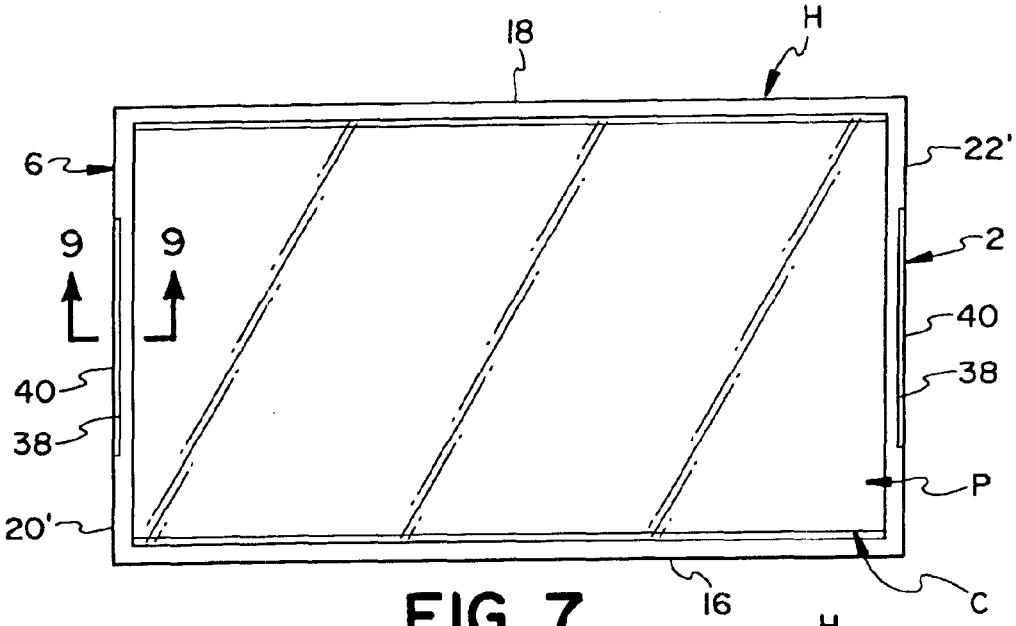
FIG. 7 is a top plan view showing a modification of the invention.
Figure 9:
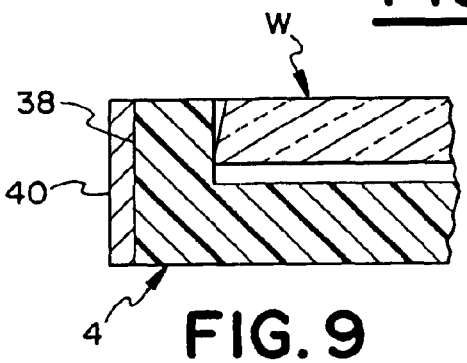
FIG. 9 is an enlarged fragmentary cross section of the modification of FIG. 7 taken along the line 9—9 and viewed in the direction of the arrows.

In FIGS. 7 and 9, the sides 20' and 22' are modified to have a pocket recess 38 for receiving a strip magnet 40 which functions to hold the holder H to a magnet attracting surface S.

Figure 8:
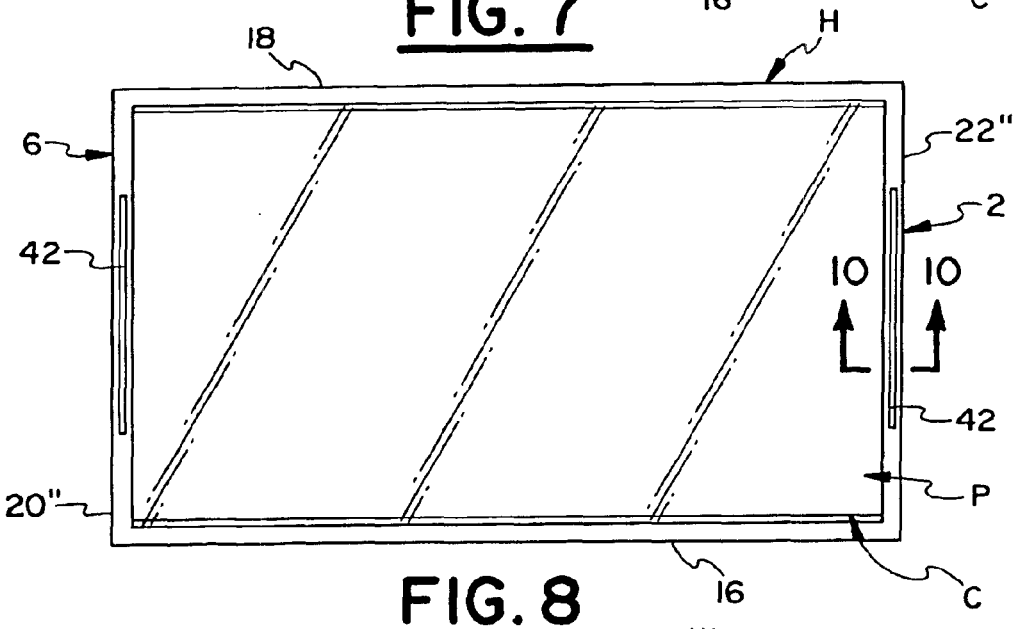
FIG. 8 is a top plan view showing another modification of the invention.
Figure 10:
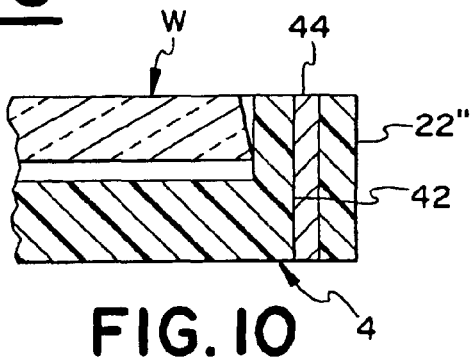
FIG. 10 is an enlarged fragmentary cross section of the modification of FIG. 8 taken along the line 10—10 and viewed in the direction of the arrows.

In FIGS. 8 and 10, the sides 20" and 22" have slots 42 for receiving a strip magnet 44. The strip magnet 40 shown in FIGS. 7 and 9 may be secured in the pocket recess 38 by adhesive means. The strip magnet 44 mounted in a slot 42 may be adhesively secured or wedged into the slots 42. The modifications shown in FIGS. 7 through 10 may require the sides 20', 22', 20" and 22" to be wider than the sides 20 and 22 of FIGS. 1 through 4. This will allow the strip magnets 40 and 44 to provide adequate holding power if necessary, although, it is felt that today's strip magnets are quite powerful. Although not shown in the drawings, it is obvious that the positioning of the magnets 40 and 44 could be in any one of the sides of the magnetic card holder H.

While this invention has been described as having a preferred design, it is understood that it is capable of further modifications, and uses and/or adaptions of the invention and following in general the principal of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A flexible magnetic card holder comprising:

a) a flexible magnetic card receiving frame for securing said magnetic card holder to a magnet attracting surface;

b) said frame having a magnetic backing plate;

c) said backing plate having an upstanding peripheral lip forming with said backing plate a card receiving pocket;

d) said upstanding peripheral lip having top, outer and inner surfaces;

e) a flexible, transparent and removable window positionable in said card receiving packet and having top and bottom surfaces;

f) said flexible, transparent and removable window when positioned in said card receiving pocket above a card mounted in said card receiving pocket, having its top surface lying in a plane substantially even with said top surface of said upstanding peripheral lip;

g) said flexible, transparent and removable window for said card receiving pocket having a peripheral edge frictionally engageable and cooperating with said inner surface of said upstanding peripheral lip to lock a card and said flexible, transparent and removable window in said card receiving pocket;

h) said flexible, magnetic card receiving frame and said flexible, transparent and removable window each having first non-flexed and second flexed positions and each having memory, so that when flexed from said first non-flexed position when said flexible transparent and removable window is positioned above a card in said card receiving pocket to said second flexed positions, said flexible, transparent and removable window, will be unlocked from said card receiving pocket for removal of the card positioned in said card receiving pocket;

i) said upstanding peripheral lip has at least one recess; and j) said at lest one recess includes a magnetic strip.

2. A flexible magnetic card holder as in claim 1, and including:

a) securing means for said magnetic strip.

3. A flexible magnetic card holder comprising:

a) a flexible magnetic card receiving frame for securing said magnetic card holder to a magnet attracting surface;

b) said frame having a magnetic backing plate;

c) said backing plate having an upstanding peripheral lip forming with said backing plate a card receiving pocket;

d) said upstanding peripheral lip having top, outer and inner surfaces;

e) a flexible, transparent and removable window positionable in said card receiving packet and having top and bottom surfaces;

f) said flexible, transparent and removable window when positioned in said card receiving pocket above a card mounted in said card receiving pocket, having its top surface lying in a plane substantially even with said top surface of said upstanding peripheral lip;

said flexible, transparent and removable window for said card receiving pocket having a peripheral edge frictionally engageable and cooperating with said inner surface of said upstanding peripheral lip to lock a card and said flexible, transparent and removable window in said card receiving pocket;

h) said flexible, magnetic card receiving frame and said flexible, transparent and removable window each having first non-flexed and second flexed positions and each having memory, so that when flexed from said first non-flexed position when said flexible transparent and removable window is positioned above a card in said card receiving pocket to said second flexed positions, said flexible, transparent and removable window, will be unlocked from said card receiving pocket for removal of the card positioned in said card receiving pocket;

i) said upstanding peripheral lip has at least one slot; and j) said at least one slot includes a magnetic strip.

4. A flexible magnetic card holder as in claim 3, and including:

a) securing means for said magnetic strip.

* * * * *